US009316989B1

(12) United States Patent
Young

(10) Patent No.: US 9,316,989 B1
(45) Date of Patent: Apr. 19, 2016

(54) ELECTROPHOTOGRAPHIC PRINTERS HAVING SPATIAL SELF-COMPENSATION FOR IMAGE CYLINDER RUNOUT

(71) Applicant: Eastman Kodak Company, Rochester, NY (US)

(72) Inventor: Timothy John Young, Williamson, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/606,042

(22) Filed: Jan. 27, 2015

(51) Int. Cl.
*G03G 15/00* (2006.01)

(52) U.S. Cl.
CPC ..... *G03G 15/757* (2013.01)

(58) Field of Classification Search
CPC ..... G03G 15/757
See application file for complete search history.

(56) References Cited

U.S. PATENT DOCUMENTS 5,243,396 A 9/1993 Castelli et al.
6,493,012 B2 12/2002 Buch et al.
6,608,641 B1 8/2003 Alexandrovich et al.
2003/0152402 A1* 8/2003 Ehara et al. ..... 399/167
2006/0133870 A1 6/2006 Ng et al.
2007/0280729 A1* 12/2007 Murayama ..... 399/111
2010/0080626 A1 4/2010 Foster
2010/0303504 A1 12/2010 Funamoto et al.

* cited by examiner

*Primary Examiner* — David Gray
*Assistant Examiner* — Laura Roth
(74) *Attorney, Agent, or Firm* — Peyton C. Watkins; David A. Novais

(57) ABSTRACT

An image forming device includes at least two image cylinders that rotate with a time varying velocity; at least two image cylinder gears respectively attached to each image cylinder; and at least one pinion gear that drives the at least two image cylinder gears. The time varying velocity of the image cylinder gear is due to a runout of the pinion gear. The spacing between the centers of the image cylinders is determined by $$S_{12} = k\pi D_p + \frac{\alpha}{360}\pi D_p$$

where $S_{12}$ is the distance between the centers of the two image cylinders gears; k is an integer; $\alpha$ is the angle between the pitch point of the two gears; and $D_p$ is the diameter of the pinion gear.

6 Claims, 5 Drawing Sheets

ELECTROPHOTOGRAPHIC PRINTERS HAVING SPATIAL SELF-COMPENSATION FOR IMAGE CYLINDER RUNOUT

CROSS REFERENCE TO RELATED APPLICATIONS

Reference is made to commonly assigned U.S. patent application Ser. No. 14/606,039 filed Jan. 27, 2015 by Timothy J. Young, entitled: "ELECTROPHOTOGRAPHIC PRINTERS HAVING ELECTRONIC SELF-COMPENSATION FOR IMAGE CYLINDER RUNOUT" and to commonly assigned U.S. patent application Ser. No. 14/606,044 filed Jan. 27, 2015 by Timothy J. Young, entitled: "ELECTROPHOGRAPHIC PRINTERS HAVING SPATIAL SELF-COMPENSATION FOR DRIVE ROLLER RUNOUT."

FIELD OF THE INVENTION

The present invention generally relates to electrophotographic printers and, more specifically, to an apparatus for correcting for image uniformity and writing registration errors and different rotational speeds of imaging cylinders caused by inaccuracies of rotating mechanical systems such as pinion gears.

BACKGROUND OF THE INVENTION

Electrophotographic printers include a plurality of printing modules each for transferring toner to a receiver. Each printing module includes an imaging cylinder on which a latent image is formed which is then converted to a visible by the deposition on toner particles. The imaging cylinder then either transfers the toner to a receiver or transfers to one or more intermediate cylinders which then transfers to the receiver.

Each imaging cylinder is driven by a motor whose rotation is transmitted to the imaging cylinder by transmitting members, such as gears and pinions. These transmitting members may have its shaft not rotating exactly in line with the main axis, commonly referred to herein as runout. The prior art discloses several methods for compensating for runout.

For example, U.S. Pat. No. 5,243,396 discloses a timing belt of the speed reduction drive train having a peripheral length which is selected from a range of values dependent on a preselected speed reduction ratio between the driven pulley and the driving pulley. Further, each one of the range of values is an integral improper fraction or integral multiple of the circumference of the driven pulley. Moreover, the driving pulley of the last pulley belt set coupled to the photosensitive member and a driven pulley prior to the last pulley belt set rotate n full rotations as the photosensitive member rotates from the image forming location to the image transfer location. In conjunction, every speed reduction ratio of all pulley belt sets prior to the last pulley belt set is an integer value.

U.S. Patent Publication No. 20100080626 discloses a digital electrophotographic printer for printing on a receiver. The printer includes a gear drive assembly having at least two gears. A first gear includes first gear teeth and a second gear includes second gear teeth, each of which drives a photoconductor in a separate print engine in which the first gear teeth and the second gear teeth are offset an by offset value, b. Two or more print engines share the drive assembly, each print engine having an imaging cylinder and a writer. A controller directs a relative gear position of the first and second gear in relation to the drive assembly so that the two gears are out of phase to minimize the appearance of drive assembly tooth related velocity variations.

U.S. Patent Publication No. 20100303504 discloses a multicolor imaging system having a plurality of photoreceptors on which electrostatic latent images are generated. A plurality of development units generate toner images based on the electrostatic latent images on the photoreceptors, respectively. A transfer unit includes an endless belt element onto which the toner images are transferred sequentially while rotated, and a belt drive element which rotates the belt element. A drive unit controls the transfer unit via the belt drive element based on a fluctuation in a rotary velocity of the belt element so that the belt element rotates at a constant velocity, and drives one of the plurality of photoreceptors together with the belt element. A toner pattern detector detects a toner pattern on the belt element, and an arithmetic unit calculates a periodic fluctuation in each of the photoreceptors from information detected by the toner pattern detector. A rotary position detector detects rotary positions of the photoreceptors, and a controller adjusts a phase difference in rotations of the photoreceptors based on information detected by the rotary position detector. A drive gear system includes a gear and the belt drive element, and a gear system for the photoreceptors other than the one photoreceptor, comprised of a gear and at least one phase adjusting gear having a same rotary cycle as that of the gear of the drive gear system to adjust the rotary velocity of the photoreceptors other than the one photoreceptor to fluctuate in a same cycle as that of the one photoreceptor.

Although satisfactory, theses prior art methods include drawbacks. U.S. Pat. No. 5,243,396 involve the use of adjusting belts and the like which includes a tradeoff of adding inherent tolerance inaccuracies into one portion of the system for adjusting another portion the system. U.S. Patent Publication No. 20100080626 adjusts the phase of two independent gears but does not address the inaccuracies in each gear assembly independently of each other. U.S. Patent Publication No. 20100303504 addresses a phase difference in rotation of "two" photoreceptors but does not address the inaccuracies in each photoreceptor independently caused by runout. The use of separate motors to control the motion of each imaging module results in redundant subsystem hardware and unnecessary cost. Similarly, encoders or other complex sensing systems to sense the positional errors in motion control systems are expensive and should be avoided where possible.

The present invention addresses the shortcomings of the prior art.

SUMMARY OF THE INVENTION

The present invention is directed to overcoming one or more of the problems set forth above. Briefly summarized, according to one aspect of the invention, the invention resides in an image forming device having at least two image cylinders that rotate with a time varying velocity; at least two image cylinder gears respectively attached to each image cylinder; and at least one pinion gear that drives the at least two image cylinder gears; wherein the time varying velocity of the image cylinder gear is due to a runout of the pinion gear; wherein the spacing between the centers of the image cylinders is determined by $$S_{12} = k\pi D_p + \frac{\alpha}{360}\pi D_p$$

where $S_{12}$ is the distance between the centers of the two image cylinders gears; k is an integer; $\alpha$ is the angle between the pitch point of the two gears; and $D_p$ is the diameter of the pinion gear.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

The invention has been described in detail with particular reference to certain preferred embodiments thereof, but it will be understood that variations and modifications can be effected within the spirit and scope of the invention.

In the following description, some embodiments will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, embodiments described herein. Other aspects of such algorithms and systems, and hardware or software for producing and otherwise processing the image signals involved therewith, not specifically shown or described herein, are selected from such systems, algorithms, components, and elements known in the art. Given the system as described herein, software not specifically shown, suggested, or described herein that is useful for implementation of the invention is conventional and within the ordinary skill in such arts.

Figure 1:
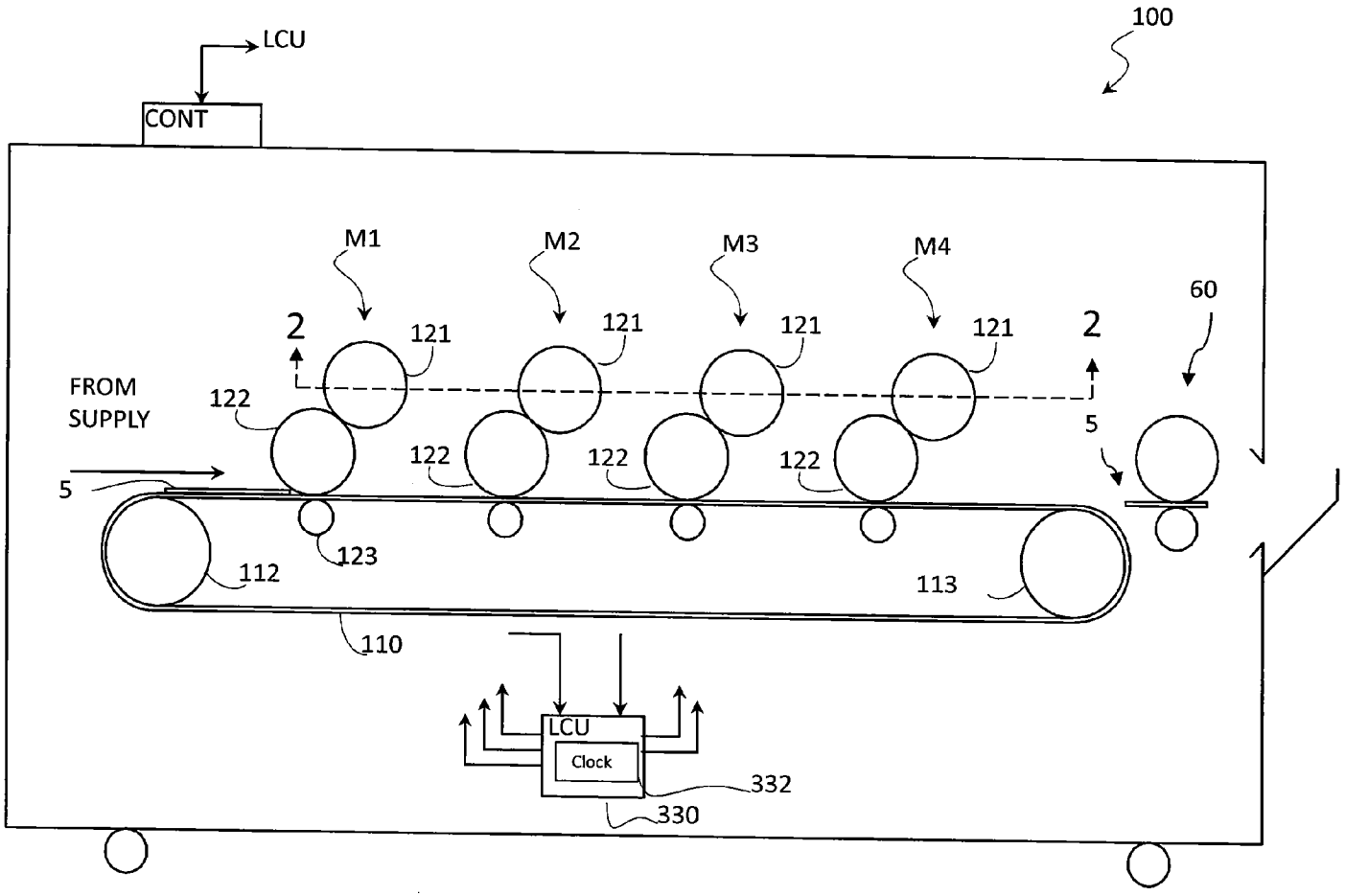
FIG. 1 is a side view of an electrophotographic printer for use with the present invention.

Turning now to FIG. 1, there is shown a side view illustrating portions of a typical electrophotographic printer 100 useful with various embodiments of the present invention. Electrophotographic printer 100 is adapted to produce print images, such as, but not limited to, cyan, magenta, yellow and black (CMYK) on a receiver. Images can include either or a combination of text, graphics, photos, and other types of visual content. Various components of the electrophotographic printer 100 are shown as rollers; other configurations are also possible, such as configurations having belts.

The electrophotographic printer 100 is an electrophotographic printing apparatus having a number of tandemly arranged electrophotographic image-forming printing modules M1, M2, M3, and M4, also known as electrophotographic imaging subsystems. Each printing module M1-M4 includes an imaging cylinder 121, imaging systems subsystems such as a charger, an exposure system and a toning station (all well known in the art and not shown) associated with each imaging cylinder 121, and optionally a transfer intermediate cylinder 122. Each printing module M1, M2, M3, and M4 produces a single-color toner image for transfer using a respective transfer subsystem (not shown for simplicity and clarity) to a receiver 5 successively moved through the modules M1-M4 by a receiver transport belt 110, which is rotated by a receiver transport drive idler 112 and a receiver transport drive roller 113. The receiver 5 is transported from a supply unit (not shown), which can include active feeding subsystems as is known in the art, into the electrophotographic printer 100. In various embodiments, the visible image can be transferred directly from an imaging cylinder 121 to the receiver 5, or from an imaging cylinder 121 to a transfer intermediate cylinder 122, and then to the receiver 5. The receiver 5 is, for example, a selected section of a web of, or a cut sheet of, planar media such as paper or transparency film.

In one embodiment of the electrophotographic process (which uses the transfer intermediate cylinder 122), an electrostatic latent image is formed on the imaging cylinders 121 by uniformly charging photoreceptors of the development system subsystem (not shown) associated with the imaging cylinder 121 and then discharging selected areas of the uniform charge to yield an electrostatic charge pattern corresponding to the desired image (a "latent image"). After the latent image is formed, charged toner particles are brought into the vicinity of the imaging cylinder 121 by the imaging system subsystem (not shown) and are attracted to the latent image to develop the latent image into a visible image. Note that the visible image may not be visible to the naked eye depending on the composition of the toner particles. It is noted that the toner can be applied to either the charged or discharged parts of the latent image After the latent image is developed into a visible image on the imaging cylinders 121, each transfer intermediate cylinder 122 respectively receives the visible image for transfer to a suitable receiver 5 which is brought into juxtaposition with the visible image on the transfer intermediate cylinder 122. A suitable electric field is applied by the transfer system subsystem (not shown) to transfer the toner particles of the visible image to the receiver 5 to form the desired print image on the receiver 5. This imaging process is repeated for printing modules M2-M4. In another embodiment as referred to above, the visible image may be transferred directly from the imaging cylinders 121 to the receiver 5 in which case the transfer intermediate cylinders 122 are omitted.

The receiver 5 is then subjected to either heat or pressure, or a combination of heat and pressure, by a fuser 60 to permanently fix ("fuse") the toner particles to the receiver 5. The receivers 5 carrying the fused image are transported in a series from the fuser 60 along a path either to a remote output tray (not shown), or for duplex printing, back to the printing modules M1-M4 to create an image on the backside of the receiver 5 to form a duplex print.

In various embodiments, between the fuser 60 and the output tray (not shown), the receiver 5 passes through a finisher (not shown) which performs various media-handling operations, such as folding, stapling, saddle-stitching, collating, and binding.

The electrophotographic printer 100 includes the main printer apparatus logic and control unit (LCU) 330, which receives input signals from the various sensors associated with the electrophotographic printer 100 and sends control signals to the components of the electrophotographic printer 100. The LCU 330 includes a clock 332 which alters a writing frequency of the electrophotographic printer 100. As will be readily apparent after FIGS. 2-5 are discussed below, the frequency of the clock 332 matches a time varying velocity of the imaging cylinders 121. This corrects for image registration error due to the time varying velocity of the imaging cylinders 121 which is due to a runout of a pinion gear 230 (see FIGS. 2 and 3). The LCU 330 may also include a microprocessor incorporating suitable look-up tables and control software executable by the LCU 330. It can also include a field-programmable gate array (FPGA), programmable logic device (PLD), microcontroller, or other digital control system. The LCU 330 can include memory for storing control software and data. Sensors associated with the fuser 60 provide appropriate signals to the LCU 330. In response to the sensors, the LCU 330 issues command and control signals that adjust the heat or pressure within fuser 60 and other operating parameters of fuser 60 for receivers 5. This permits the electrophotographic printer 100 to print on receivers of various thicknesses and surface finishes, such as glossy or matte.

Image data for writing by the electrophotographic printer 100 can be processed by a raster image processor (RIP; not shown), which can include a color separation screen generator or generators. The output of the RIP can be stored in frame or line buffers for transmission of the color separation print data to each of the respective LED writers, e.g. for black (K), yellow (Y), magenta (M), and cyan (C) respectively. The RIP or color separation screen generator can be a part of electrophotographic printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding electrophotographic printer 100 are provided in U.S. Pat. No. 6,608,641, issued on Aug. 19, 2003, to Peter S. Alexandrovich et al., and in U.S. Publication No. 20060133870, published on Jun. 22, 2006, by Yee S. Ng et al., the disclosures of which are incorporated herein by reference.

The output of the RIP can be stored in frame or line buffers for transmission of data one line at a time to each of the respective LED writers, e.g. for black (K), yellow (Y), magenta (M), and cyan (C) respectively. In the present invention, by controlling the clock frequency that controls the writing of each line of data by the LED writers onto the respective imaging cylinders 121, errors in image placement on the imaging cylinder can be corrected and, specifically, compensation for motion control errors of the imaging cylinders can be introduced.

Figure 2:
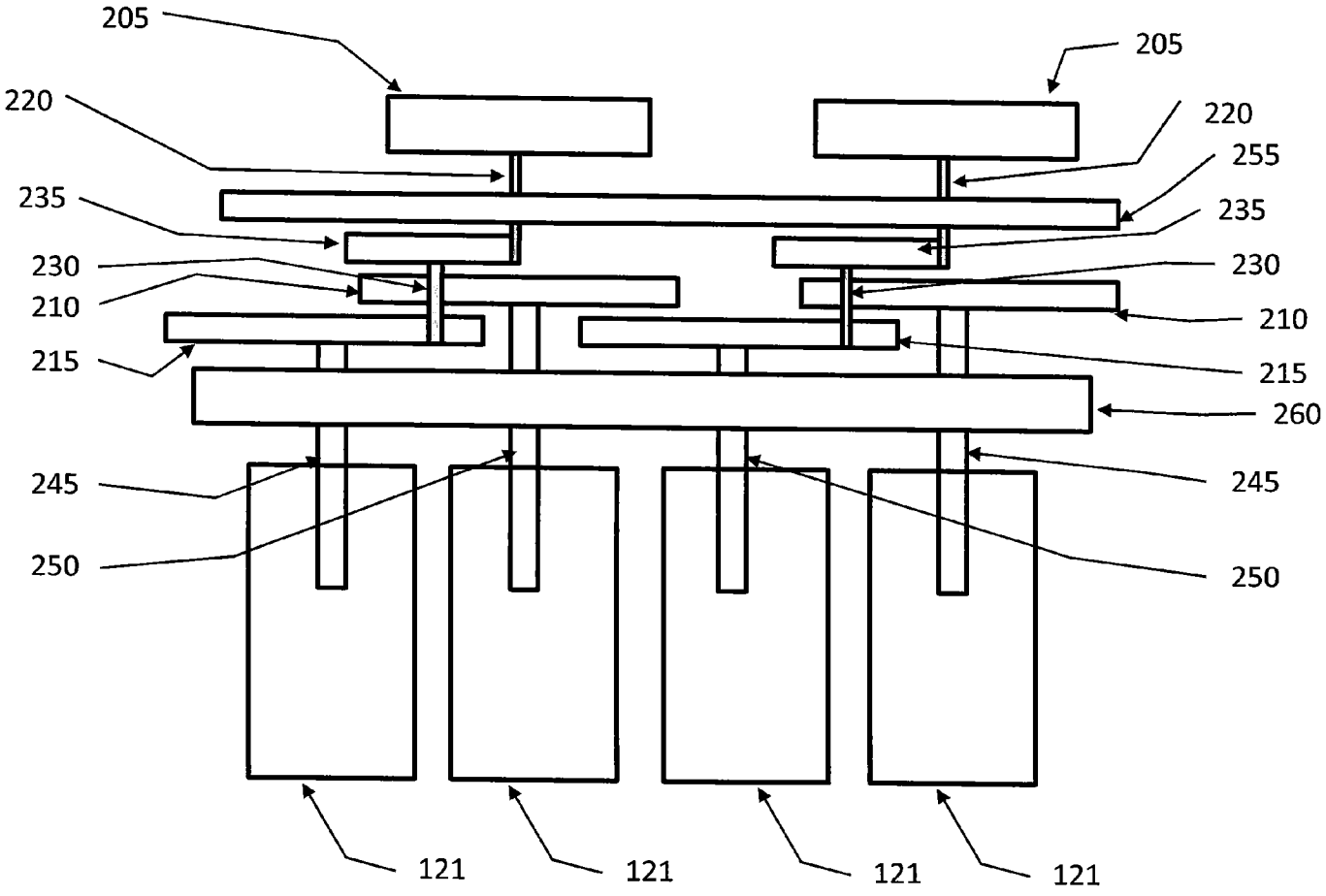
FIG. 2 is a block diagram on an imaging cylinder and its associated gears and pinions of the present invention.
Figure 3:
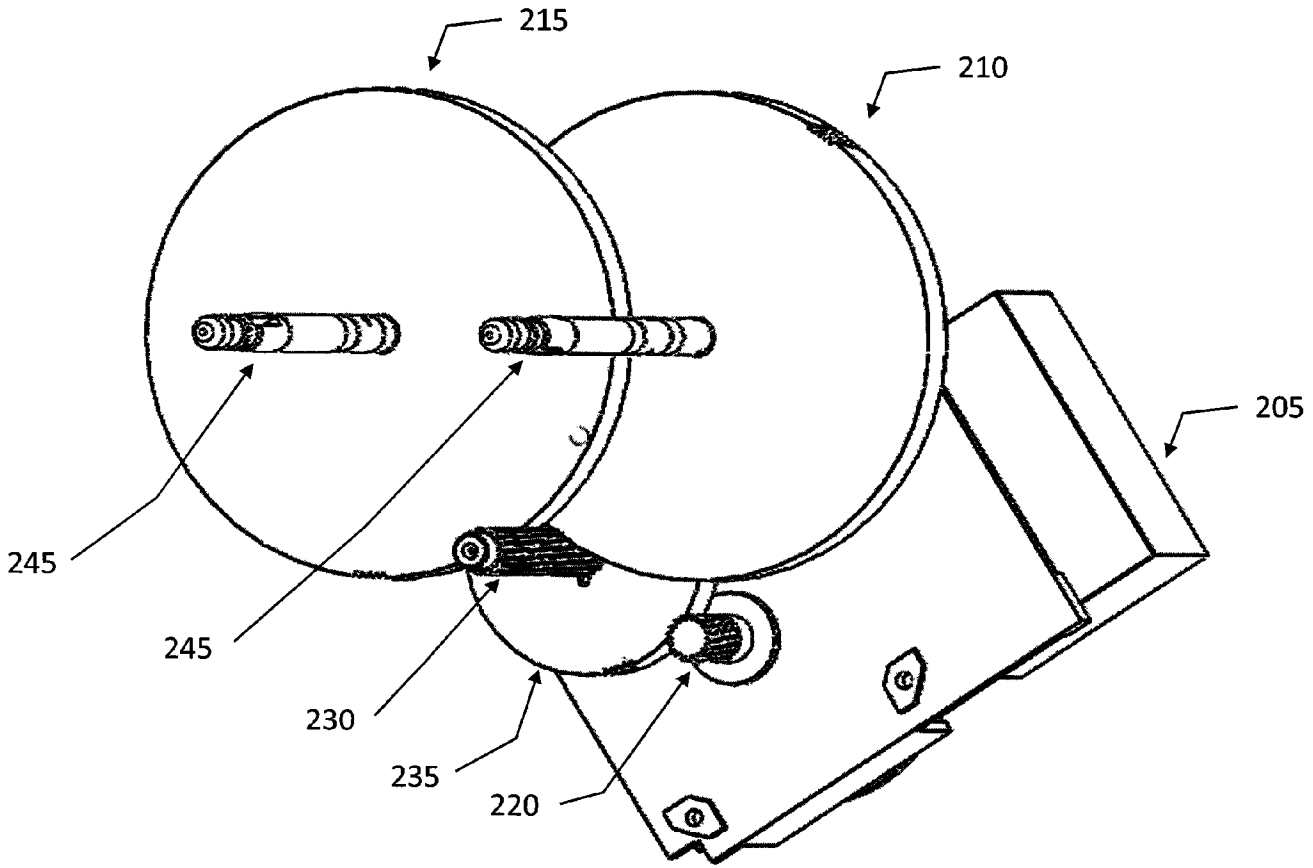
FIG. 3 is a perspective view of FIG. 2 with the imaging cylinders omitted for clarity of components that would otherwise be hidden.

Before discussing the physical components of the present invention as shown in FIGS. 2 and 3, it is helpful to understand the drawback that the present invention solves. In this regard, it is noted that an inaccuracy of rotating mechanical systems, such as the pinion gear 230 (see FIGS. 2 and 3), may have its shaft not rotating exactly in line with the main axis of the pinion gear 230 (referred to herein as runout). This can ultimately cause the imaging cylinders 121 (see FIGS. 1 and 2) to rotate in a time varying manner which produces registration errors. In one embodiment, the present invention solves this undesirable effect by having the frequency of the clock 332 (see FIG. 1) to match the time varying velocity of the imaging cylinders 121 to correct for image registration error due to the time varying velocity of the image cylinders which is due to a runout of the pinion gear 230.

Returning to a discussion of FIGS. 2 and 3, there is shown the imaging cylinders 121 and its associated components. In this regard, a drive motor 205 drives a drive motor gear 220 which drives a pinion drive gear 235 that rotates at a constant angular velocity. The pinion gear 235, in turn, causes a pinion gear 230 (which may have runout) to rotate. The pinion gear 230 engages two imaging cylinder gears 215 and 210 which respectively cause the imaging cylinders 121 to rotate. It is desirable for the number of gear teeth on the imaging cylinder gear to be an integer multiple of the number of gear teeth on the pinion gear. Because the pinion gear 230 may have runout, the imaging cylinders 121 may rotate in a time varying velocity which is reproducible and periodic. This is solved by the present invention having the clock 332 match its frequency of the image writer 310 to the time varying velocity of the respective imaging cylinders 121. It is noted that there are two mechanical plates (mech plates 255 and 260) for providing structural support for the above discussed components.

The synchronization of the image writer to the periodic time varying velocity of the imaging cylinder 121 is done in this case by varying the clock signals to the writer. The clock 332 runs at a high frequency that results in outputting many pulses for each line of data to be written. A clock divider circuit in the LCU takes the input signal of the clock and generates an output signal of a frequency f/n where f is the input clock frequency and n is an integer. By varying the pulse count n, the LCU can alter the output frequency, which is used to control the LED writer.

It is desirable to output an index pulse signal to indicate the position of the pinion gear and the imaging cylinder to indicate the start of printing and the starting point for each turn of the imaging cylinder. One means for achieving this is to have an optical sensor which detects a mark on the imaging cylinder 121.

The variation of motion of the cylinder can be measured by an optical sensor such as encoder device as described in U.S. Pat. No. 6,493,012 which is incorporated herein by reference. A preferred means of determining the frequency correction needed is to print on a sheet of paper a set of test patches written with no writer frequency compensation. The resulting variation in location of the test patches will indicate the period changes in the surface speed of the imaging cylinder due to the pinion gear run out and other sources of variation such as image cylinder run out. Variation data can be measured using a flat bed scanner to read the locations of the test patches on the receiver. The information can be stored in a look up table with the desirable changes in clock frequency (or in the pulse count n) needed to compensate for the speed variations associated with each turn of the pinion gear or image cylinder.

Figure 4:
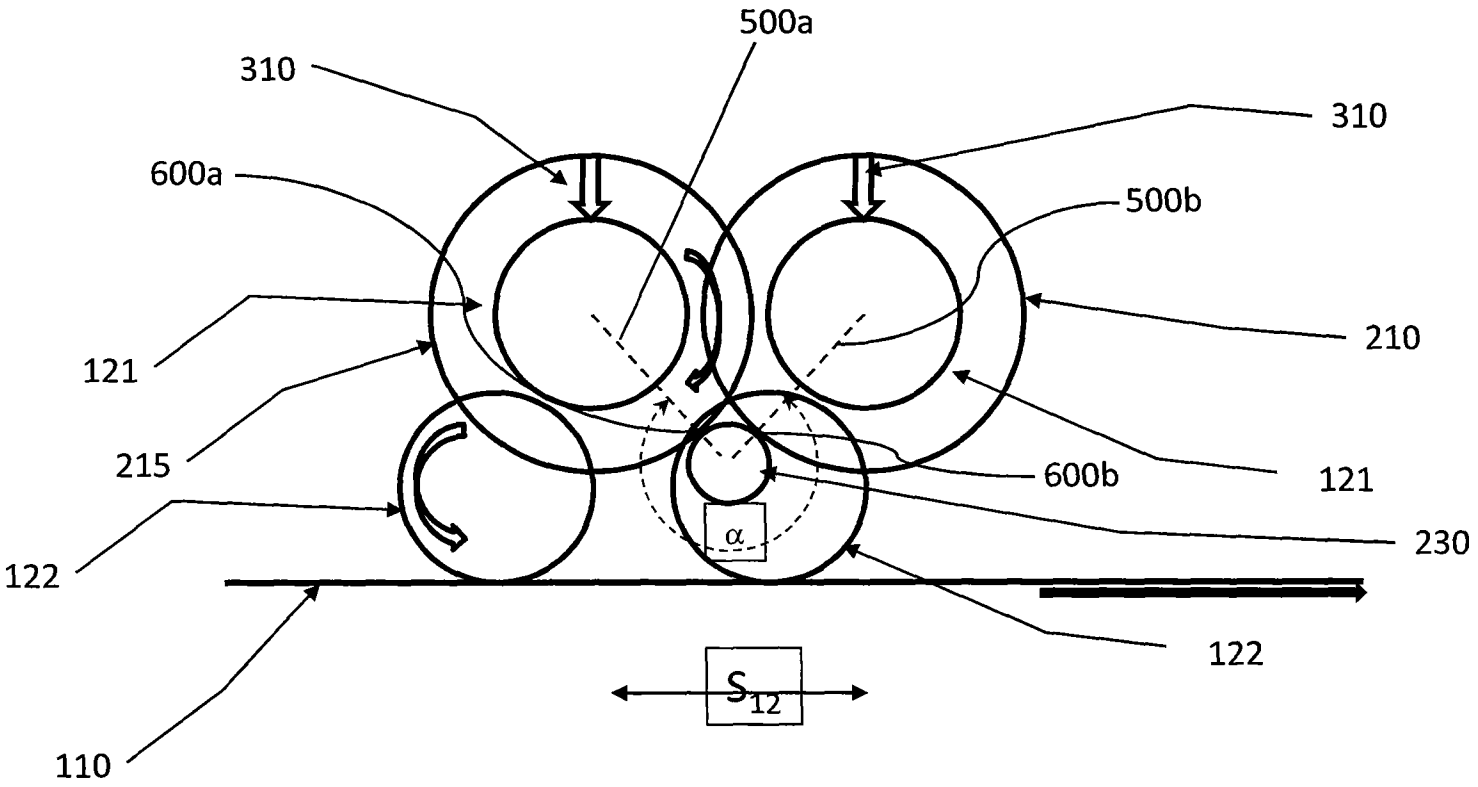
FIG. 4 is a side view of the imaging cylinders and imaging intermediate cylinders for illustrating a spatial relationship between the centers of the imaging cylinders to compensating for runout.

Referring to FIG. 4, there is shown an exploded, side view of the imaging cylinders 121 with their respective associated imaging drive gears 210 and 215 and transfer intermediate cylinders 122. This embodiment solves another drawback of the prior art in that the imaging cylinders 121 may not rotate at the same angular velocity relative to each other due to runout of the pinion gears 230. This can result in lines of data bring written at one pitch on the first image cylinder while being written at a different pitch on the second cylinder. Ideally, the areas of the CMYK image that are superimposed by transfer to the receiver being transported by the receiver transport belt 110 (or directly to an intermediate transfer belt in an alternate printer design) will have been written at the same pitch by the image writer 310. The present invention solves this by having the spacing between each center of adjacent imaging cylinder gears 210 and 215 having a calculated distance (d) of the present invention. The calculated distance is spacing between the centers of the imaging cylinder gears 210 and 215 is determined by equation 1.

$$S_{12} = k\pi D_p + \frac{\alpha}{360}\pi D_p \qquad \text{Eq. 1}$$

where $S_{12}$ is the distance between the centers of the two adjacent imaging cylinders gears 210 and 215; k is an integer; $\alpha$ is the angle between the pitch point of the gears and more specifically, the obtuse angle between line 500*a* that extends between the center of gear 215 and the center of pinion gear 230 through pitch point 600*a* between gears 215 and 230, and line 500*b* that extends between the center of gear 210 and the center of pinion gear 230 through pitch point 600*b* between gears 210 and 230; and $D_p$ is the pitch diameter of the pinion gear 230.

Figure 5:
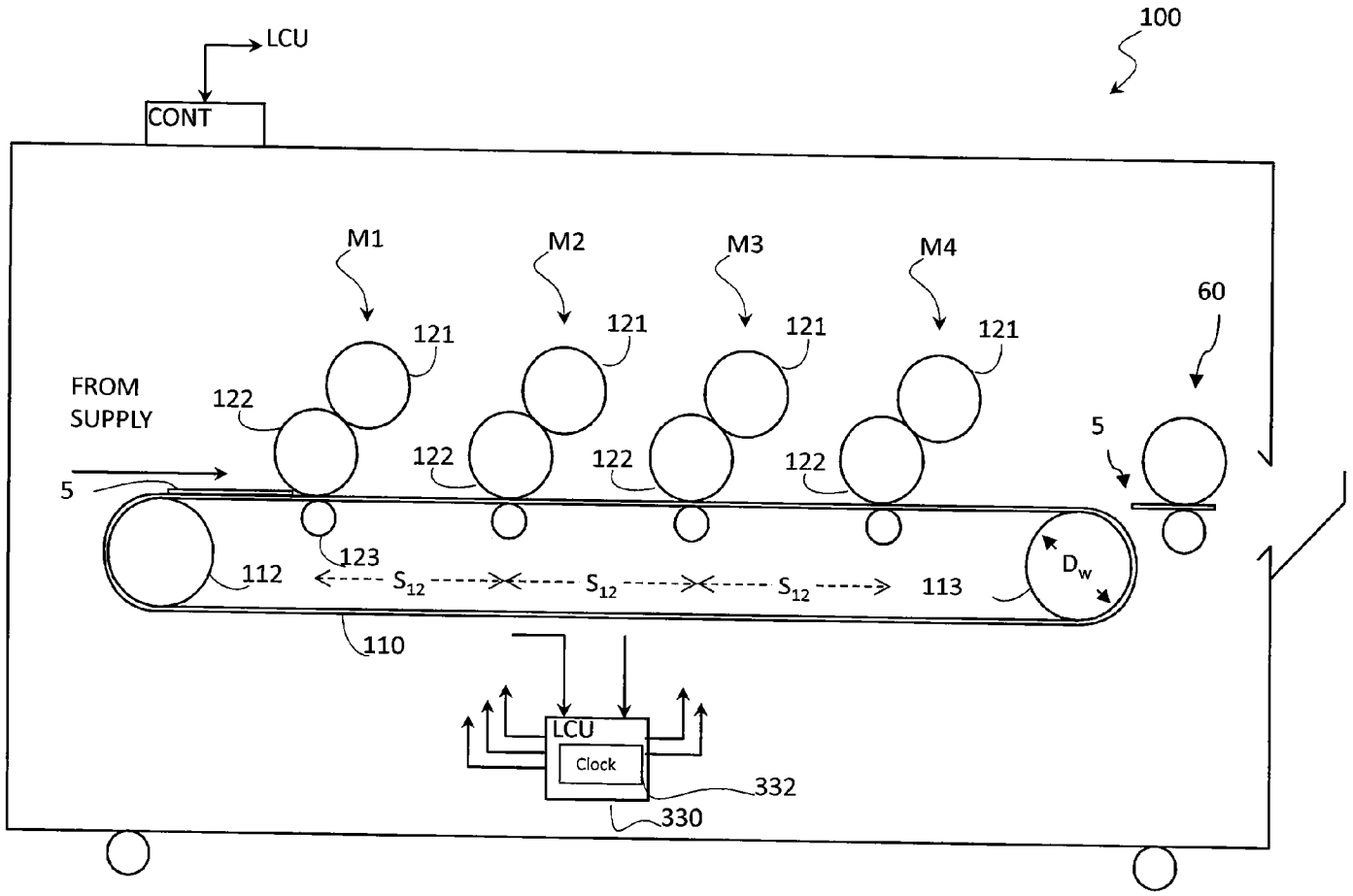
FIG. 5 is a side view of an electrophotographic printer for use with another embodiment of the present invention.

Referring to FIG. 5, there is shown an alternative embodiment of FIG. 1 in which the receiver transport drive roller 113 rotates at a constant angular velocity and has time varying rotation caused by runout. The receiver transport drive roller 113 is connected to a drive motor (not shown) by a drive shaft (not shown). Runout of the receiver transport drive roller 113 is due to the drive shaft not exactly in line with the main axis of the receiver transport drive roller 113. It is noted that the time varying rotation is also reproducible and periodic. Runout on the receiver transport drive roller 113 causes the receiver transport belt 110 to also rotate in a time vary manner which would cause undesirable writing effects if not corrected. The present invention solves this problem by having the spacing between the point in which the transfer intermediate cylinder 122 contacts and transfer the image to the receiver 5 (writer transfer point) and the receiver transport belt 110 spaced according to a spacing function of the present invention (equation 2). It is noted that the transfer intermediate cylinders 122 may not be used in some embodiment of the electrophotographic printer 100 so the writer transfer point as used herein will be which particular cylinder is performing writing to the receiver 5 (writing cylinder). The spacing function is:

$$S_{12}=k\pi D_w \qquad \text{Eq. 2}$$

where $S_{12}$ is the distance between the writer transfer points of two adjacent writing cylinders and k is an integer and $D_w$ is the diameter of the image web drive roller.

The invention has been described in detail with particular reference to certain preferred embodiments thereof, but it will be understood that variations and modifications can be effected within the spirit and scope of the invention.

PARTS LIST

M1-M5 printing modules
5 receiver
60 fuser
100 electrophotographic printer
110 receiver transport belt
112 receiver transport idler roller
113 receiver transport drive roller
120 transfer backup roller
121 imaging cylinder
122 transfer intermediate cylinder
205 drive motor
210 image cylinder drive gear
215 image cylinder drive gear
220 drive motor gear
230 pinion gear
235 pinion drive gear
245 image cylinder coupling
250 image cylinder coupling
330 LCU
332 clock

The invention claimed is:

1. An image forming device comprising:

at least two image cylinders that rotate with a time varying velocity;

at least two image cylinder gears respectively attached to each image cylinder; and at least one pinion gear that drives the at least two image cylinder gears; wherein the time varying velocity of the image cylinder gear is due to a runout of the pinion gear;

wherein the spacing between the centers of the image cylinders is determined by $$S_{12} = k\pi D_p + \frac{\alpha}{360}\pi D_p$$

where $S_{12}$ is the distance between the centers of the two image cylinders gears; k is an integer; $\alpha$ is the angle between the pitch point of the two gears; and $D_p$ is the pitch the diameter of the pinion gear.

2. The image forming device of claim 1, wherein the time varying velocity of the image cylinder is reproducible and periodic.

3. The image forming device as in claim 1, wherein the pinion gear has a constant angular velocity.

4. The image forming device as in claim 1, wherein the pinion gear is connected to a drive motor by a drive shaft.

5. The image forming device as in claim 4, wherein runout of the pinion gear is due to the drive shaft not exactly in line with the main axis of the pinion gear.

6. The image forming device as in claim 1, wherein a number of gear teeth on the imaging cylinder gear is an integer multiple of the number of gear teeth on the pinion gear.

* * * * *